US005478648A

United States Patent [19]

Stein et al.

[11] Patent Number: 5,478,648

[45] Date of Patent: Dec. 26, 1995

[54] SPIN FINISHED ARAMID FIBERS AND USE THEREOF

[75] Inventors: Gerhard Stein, Kelheim; Richard Neuert, Winkelhaid, both of Germany

[73] Assignee: Hoechst Aktiengesellschaft, Frankfurt, Germany

[21] Appl. No.: 377,446

[22] Filed: Jan. 24, 1995

[30] Foreign Application Priority Data

Jan. 26, 1994 [DE] Germany ..... 44 02 193.3

[51] Int. Cl.[6] ..... D02G 3/00

[52] U.S. Cl. ..... 428/375; 428/395; 8/115.64; 8/115.56; 8/115.54; 252/8.6; 252/8.9

[58] Field of Search ..... 428/375, 395; 8/115.64, 115.56, 115.54; 252/8.6, 8.9

[56] References Cited

U.S. PATENT DOCUMENTS 4,191,656 3/1980 Marshall ..... 252/8.6

4,995,884 2/1991 Ross et al. ..... 8/115.6

5,011,616 4/1991 Marshall et al. ..... 252/8.9

*Primary Examiner*—N. Edwards

*Attorney, Agent, or Firm*—Connolly & Hutz

[57] ABSTRACT

Novel aramid fibers with a spin finish having useful properties for the production of sheet materials are described in the present application. The aramid fibers contain at least three elements including an anionic antistat based on phosphoric, phosphonic, or phosphoric and phosphonic esters; a compound of the formula $^{1}$—COO—($CH_2$—$CH_2$—O—)$_x$—$R^2$; and a compound of the formula $R^2$—O—($R^4$—O)$_y$—$R^5$, wherein $R^1$ is alkyl or alkenyl, x is an integer from 2 to 20 $R^2$ is hydrogen or alkyl, $R^3$ is alkyl or alkenyl, y is an integer from to 8, $R^4$ is ethylene, propylene, or butylene, and $R^5$ is alkyl.

17 Claims, No Drawings

SPIN FINISHED ARAMID FIBERS AND USE THEREOF

BRIEF SUMMARY OF THE INVENTION

The present invention relates to aramid fibers which have been coated with a selected spin finish and to the use of these fibers.

DESCRIPTION OF THE PRIOR ART

Aromatic polyamides—also known as aramids—are known fiber-forming materials of high chemical resistance. Aramid fibers are notable in particular for good mechanical properties, such as high strength and moduli.

Aramid fibers, like other fibers too, are customarily spin finished in order that the processing properties in the after-treatment or further processing may be improved. Examples of spin finish systems for aramid fibers may be found in WO -A-92-15,747, EP-A-416,486, EP-A-423,703, JP-A-49-62, 722, JP-A-51-88,798 and JP-A-58-46,179 and also Research Disclosures 219,001 and 195,028.

DETAILED DESCRIPTION

It has now been found that selected spin finishes confer excellent further processing properties on aramid fibers. The fibers treated according to the present invention exhibit good interfilament cohesion and good antistatic properties of the individual filaments. The present invention provides spin finishes of low surface or interfacial tension and minimal self-color. The spin finishes to be used according to the present invention ensure uniform wetting and dispersion on the fiber surface, significantly reduce the filament/metal friction, and enable processing at elevated temperatures, for example at temperatures of up to 200° C.

The spin finish system of the present invention is notable for good biodegradability; for instance, it is possible to produce spin finishes which are more than 80% biodegradable within the meaning of Administrative Provision 28 of the German Washing and Cleaning Agents Act.

The present invention concerns aramid fibers with a spin finish comprising

A) an anionic antistat based on phosphoric and/or phosphonic esters,

B) a compound of the formula I $$R^1—COO—(CH_2—CH_2—O—)_x—R^2 \quad \text{(I) and}$$

C) a compound of the formula II $$R^3—O—(R^4—O)_y—R^5 \quad \text{(II),}$$

where $R^1$ is alkyl or alkenyl, x is an integer from 2 to 20, preferably 3–15, and $R^2$ is hydrogen or alkyl, $R^3$ is alkyl or alkenyl, y is an integer from 1 to 8, $R^4$ is ethylene or, when y is 2, 3 or 4, some of the $R^4$ radicals can also be propylene or butylene, and $R^5$ is alkyl, especially methyl.

The spin finish to be used according to the present invention is applied to the aramid fibers in the amount adapted to the particular purpose. This amount customarily ranges from 0.2 to 4% by weight, preferably from 0.5 to 2% by weight, based on the amount of fiber.

The proportions of the individual components A), B) and C) can be chosen within wide limits.

Component A) is customarily used in amounts from 10 to 40% by weight.

Component B) is customarily used in amounts from 20 to 60% by weight.

Component C) is customarily used in amounts from 10 to 40% by weight.

These amounts are each based on the total amount of components A), B) and C) .

As well as these components A) to C), the aramid fiber spin finishes of the present invention may include further ingredients customary for spin finishes. Examples are corrosion inhibitors, coloring components, such as pigments, biocides and preservatives.

Component A) can be any desired anionic antistat that contains phosphoric and/or phosphonic ester groups.

Examples are salts of phosphoric esters with monohydric alcohols, especially aliphatic alcohols, or salts of phosphonic esters with monohydric alcohols, especially alkyl- or aryl-phosphonic esters with aliphatic alcohols. The aliphatic alcohols which can be used for preparing the phosphoric or phosphonic esters are fatty alcohols with or without single or multiple ethylenic unsaturation, especially aliphatic alcohols having 10 to 20 carbon atoms, such as decanol, dodecanol, tridecanol, tetradecanol, hexadecanol, octadecanol or eicosanol. Furthermore, it is also possible to use monohydric alcohols derived from polyalkylene oxides, such as polyethylene oxide, polypropylene oxide or polybutylene oxide. The number of alkylene oxide repeat units therein can be up to 10. Examples of such compounds are to be found in EP-A-423,703.

Component A) preferably comprises a salt of a mono- or dialkyl phosphate, a salt of a mono- or diaryl phosphate, a salt of an alkylphosphonic ester, a salt of an arylphosphonic ester or a mixture thereof.

The salts are compounds with optional cations as counterion. Examples of preferred cations are alkali metal, alkaline earth metal and quaternary ammonium ions, in particular $Na^+$, $K^+$, diethanolammonium and triethanol-ammonium.

The alkyl radicals in the mono- or diphosphates and in the phosphonic esters can be optional alkyl radicals, which can be straight-chain or branched. Customarily they are alkyl radicals having 1–22 carbon atoms. Examples of alkyl are methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl and behenyl. Ethylenicallyunsaturated radicals are also possible.

The radicals derived from polyalkylene oxides can be for example radicals of the formulae $(CH_3—CH_2—CH_2—O)—(CH_2—CH_2—CH_2—O)_s—$ or in particular $(CH_3—CH_2—O—)—(CH_2—CH_2—O)_t—$, where s and t are each integers between 1 and 9.

The phosphoric or phosphonic esters have particularly preferably at least one $C_8—C_{20}$-alkyl radical.

The aryl radicals in the mono- or diphosphates and in the phosphonic esters can be any desired aromatic radicals, preferably aromatic hydrocarbon radicals, especially phenyl. The aryl radicals may also contain one or two inert substituents, for example alkyl radicals or halogen atoms.

The phosphoric and phosphonic esters may contain both alkyl and aryl in the same molecule.

Particularly preferred components A) are alkali metal salts, especially sodium or potassium salts, of alkyl alkylphosphonates or especially of mono- or dialkyl phosphates. Examples of such compounds are the products ®Silastol NZ from Schill und Seilacher GmbH & Co., ®Tallopol EM 5198 from Chemische Fabrik Stockhausen GmbH and ®Leomin AN from Hoechst AG.

Component B) of the spin finishes to be used according to the present invention is a specific polyethylene glycol ether ester.

$R^1$ can be any desired alkyl or alkenyl group.

Examples of possible alkyl groups are recited above in the description of the mono- or diphosphates and phosphonic esters.

The alkenyl groups can be any desired alkenyl radicals, which can be straight-chain or branched. Customarily they are alkenyl radicals having 2–20 carbon atoms. Examples of alkenyl are ethylene, propenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl.

Particular preference is given to $R^1$ as $C_{12}$—$C_{20}$-alkyl.

$R^2$ can be hydrogen or any desired alkyl group.

Examples of possible alkyl groups are recited above in the description of the mono- or diphosphates and the phosphonic esters.

$R^2$ is preferably methyl.

Component C) of the spin finishes to be used according to the present invention is a specific polyethylene glycol ether which may additionally contain polypropylene glycol and/or polybutylene glycol units.

$R^3$ can be any desired alkyl or alkenyl group or the bivalent, tervalent or tetravalent radical of an aliphatic alcohol with or without ethylenicunsaturation.

Examples of possible alkyl groups $R^3$ are recited above in the description of the mono- or diphosphates and the phosphonic esters.

Examples of possible alkyl groups $R^3$ are recited above in the description of $R^1$.

Examples of polyhydric alcohols from which $R^3$ can be derived are glycol, glycerol, trimethylolpropane and pentaerythritol.

Particular preference is given to $R^3$ as $C_{12}$–$C_{20}$-alkyl.

Particular preference is given to $R^3$ being derived from a monohydric alcohol (y= 1).

$R^4$ is customarily a polyethylene glycol radical; in the case of a tervalent or tetravalent alcohol radical $R^3$, polybutylene glycol radicals or preferably polypropylene glycol radicals can be additionally present in the molecule.

$R^5$ can be any desired alkyl group.

Examples of possible alkyl groups $R^5$ are recited above in the description of the mono- or diphosphates and the phosphonic esters.

$R^5$ is preferably methyl.

The fiber of the present invention can be made of any desired aramids. These aramids can be essentially composed of meta-aromatic monomers. An example of compounds of this type is poly(meta-phenyleneisophthalamide).

The fiber-forming material preferably comprises aramids composed to a significant proportion of para-aromatic monomers. Some of these aramids are insoluble in organic solvents and are therefore usually spun from sulfuric acid. An example of compounds of this type is poly(paraphenyleneterephthalamide).

A further preferred group of this type is soluble in organic solvents, especially in polar aprotic solvents.

A soluble aromatic polyamide for the purposes of this invention is any aromatic polyamide which has a solubility in N-methylpyrrolidone of at least 50 g/l at 25° C.

The polar aprotic organic solvent preferably comprises at least one solvent of the amide type, for example N-methyl-2-pyrrolidone, N,N-dimethylacetamide, tetramethylurea, N-methyl -2-piperidone, N,N'-dimethylethyleneurea, N,N,N',N'-tetramethylmaleamide, N-methylcaprolactam, N-acetylpyrrolidine, N,N-diethylacetamide, N-ethyl-2-pyrrolidone, N,N'-dimethylpropionamide, N,N-dimethylisobutylamide, N-methylformamide, N,N'-dimethylpropyleneurea. The preferred organic solvents for the process of the present invention are N-methyl-2-pyrrolidone, N,N-dimethylacetamide and a mixture thereof.

Preference is given to using aromatic polyamides which form isotropic solutions in polar aprotic organic solvents and which contain at least two, in particular three, different structural repeat units which differ in the diamine units.

Preferably the aramid is a polymer with the structural repeat units of the formulae III, IV and optionally V $$—OC—Ar^1—CO—NH—Ar^2—NH— \quad (III),$$

$$—OC—Ar^1—CO—NH—Ar^3—NH— \quad (IV),$$

$$—OC—Ar^1—CO—NH—Ar^4—N—H— \quad (V),$$

where $Ar^1$, $Ar^2$, $Ar^3$ and $Ar^4$ are each independently of the others a bivalent monocyclic or polycyclic aromatic radical whose free valences are disposed para or meta or comparably parallel, coaxial or angled to each other, and $Ar^2$, $Ar^3$ and, if present, $Ar^4$ each have different individual meanings within the scope of the given definitions, and the respective monomer components underlying the polymer are selected so as to produce an aromatic polyamide which forms isotropic solutions in organic solvents.

Any bivalent aromatic radicals whose valence bonds are disposed para or comparably coaxial or parallel to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be bonded linearly to one another via C—C bonds or via —CO—NH— groups.

The valence bonds in mutually coaxial or parallel disposition point in opposite directions. An example of coaxial bonds pointing in opposite directions are the biphenyl-4,4'-ylene bonds. An example of parallel bonds pointing in opposite directions are the naphthylene-1,5 or -2,6 bonds, whereas the naphthylene-1,8 bonds are parallel but point in the same direction.

Examples of preferred bivalent aromatic radicals whose valence bonds are disposed para or comparably coaxial or parallel to each other are monocyclic aromatic radicals having free valences disposed para to each other, especially 1,4-phenylene, or bicyclic fused aromatic radicals having parallel bonds pointing in opposite directions, especially 1,4-, 1,5- and 2,6-naphthylene, or bicyclic aromatic radicals linked by a C—C bond and having coaxial bonds pointing in opposite directions, especially 4,4'-biphenylylene.

Any bivalent aromatic radicals whose valence bonds are disposed meta or comparably angled to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be bonded to one another via C—C bonds or via bridging groups such as —O—, —$CH_2$—, —S—, —CO— or —$SO_2$—.

Examples of preferred bivalent aromatic radicals whose valence bonds are disposed meta or comparably angled to each other are monocyclic aromatic radicals having free valences disposed meta to each other, especially 1,3-phenylene, or bicyclic fused aromatic radicals having mutually angled bonds, especially 1,6- and 2,7-naphthylene, or bicyclic aromatic radicals linked via a C—C bond but having mutually angled bonds, especially 3,4'-biphenylylene.

Minor portions, for example up to 5 mol %, of the monomer units, based on the polymer, can be aliphatic or cycloaliphatic in nature, for example alkylene or cycloalkylene units.

Alkylene is to be understood as meaning branched and especially straight-chain alkylene, for example alkylene having two to four carbon atoms, especially ethylene.

Cycloalkylene radicals are for example radicals having five to eight carbon atoms, especially cycloalkylene.

All these aliphatic, cycloaliphatic or aromatic radicals can be substituted by inert groups. These are substituents which have no adverse effect on the contemplated application.

Examples of such substituents are alkyl, alkoxy or halogen.

Alkyl is to be understood as meaning branched and especially straight-chain alkyl, for example alkyl having one to six carbon atoms, especially methyl.

Alkoxy is to be understood as meaning branched and especially straight-chain alkoxy, for example alkoxy having one to six carbon atoms, especially methoxy.

Halogen is for example fluorine, bromine or in particular chlorine.

Preference is given to aromatic polyamides based on unsubstituted radicals.

The dicarboxylic acid unit in the aromatic polyamides comprising the structural repeat units of the formulae III, IV and optionally V is preferably terephthalic acid.

Examples of preferred diamine combinations from which these preferred structural repeat units of the formulae III, IV and V are derived are 1,4-phenylenediamine, 4,4'-diaminodiphenylmethane and 3,3'-dichloro-, 3,3'-dimethyl- or 3,3'-dimethoxybenzidine; also 1,4-phenylenediamine, 1,4-bis(aminophenoxy)benzene and 3,3'-dichloro-, 3,3'-dimethyl- or 3,3'-dimethoxybenzidine; and also 1,4-phenylenediamine, 3,4'-diaminodiphenyl ether and 3,3'-dichloro-, 3,3'-dimethyl- or 3,3'-dimethoxybenzidine; and also 1,4-phenylenediamine, 3,4'-diaminodiphenyl ether and 4,4'-diaminobenzanilide; and also 1,4-phenylenediamine, 1,4-bis(aminophenoxy)benzene and 3,4'-diaminodiphenyl ether.

Aramids which are derived from such diamine combinations and which are preferably for use according to the present invention are described in EP-A-199,090, EP-A-364,891, EP-A-364,892, EP-A-364,893 and EP-A-424,860.

The aromatic polyamides to be used according to the present invention are known per se and can be prepared by methods known per se.

Of these preferred aramids, particular preference is given particularly to those where $Ar^1$ is a bivalent monocyclic or polycyclic aromatic radical whose free valences are disposed para or comparably parallel or coaxial to each other, $Ar^2$ is a bivalent monocyclic or polycyclic aromatic radical whose free valences are disposed para or comparably parallel or coaxial to each other, $Ar^3$ is a radical of the formula VI $$—Ar^5—X—Ar^6— \quad (VI),$$

where $Ar^5$ and $Ar^6$ are independently of each other a bivalent monocyclic or polycyclic aromatic radical whose free valences are disposed para or comparably parallel or coaxial to each other or where $Ar^6$ additionally is a bivalent monocyclic or polycyclic aromatic radical whose free valences are disposed meta or comparably angled to each other, X is a group of the formula —O—, —S—, —$SO_2$—, —O——phenylene—O— or alkylene, and where $Ar^4$ has one of the meanings defined for $Ar^2$ or $Ar^3$ but differs from the particular $Ar^2$ or $Ar^3$ of a molecule.

Very particular preference is given to aramids where $Ar^1$ is 1,4-phenylene, $Ar^2$ is 1,4-phenylene or a bivalent radical of 4,4'-diaminobenzanilide, $Ar^5$ and $Ar^6$ are each 1,4-phenylene, X is —O—, —$CH_2$— or —O—1,4-phenylene—O—, and $Ar^4$ is a bivalent radical of 3,4'-diaminodiphenyl ether, of 3,3'-dichlorobenzidine, of 3,3'-dimethylbenzidine or of 3,3'-dimethoxybenzidine.

The term "fiber" is to be understood in the context of this invention in its widest sense; fiber as used herein thus includes for example endless, continuous filament fibers, such as mono- or multifilaments, or staple fibers, or pulp.

The production of the aramid fibers to be used according to the present invention can be effected by processes known per se, as described for example in EP-A-199,090, EP-A-364,891, EP-A-364,892, EP-A-364,893 and EP-A- 424,860.

The spin finish can be applied directly after the spinning of the filaments or in the aftertreatment.

Application can be by means of known apparatus, such as dipping, roller lick or spraying.

The aramid fibers treated according to the present invention can have been treated with an organic or inorganic drawing finish.

The aramid fibers of the present invention are notable for excellent mechanical properties, such as high breaking strength and initial moduli and low breaking extensions, and also for the abovementioned favorable application and further processing properties.

The fibers of the present invention preferably have filament linear densities of not less than 1.0 dtex, in particular from 1 to 20 dtex.

The tenacity of the fibers of the present invention is preferably from 140 to 290 cN/tex.

The initial modulus, based on 100% extension, of the fibers of the present invention is preferably from 40 to 130 N/rex.

The cross section of the individual filaments of the fibers of the present invention can be optional, for example triangular, tri- or multilobal or in particular elliptical or round.

The fibers of the present invention, which have excellent mechanical and thermal properties and are notable for high drawability, can be further processed and used in industry in a wide variety of ways.

The aramid fibers of the present invention, possessing good interfilament cohesion and excellent antistatic properties, are used in particular in the production of textile sheet materials by intermingling, twisting, braiding or folding. The aramid fibers of the present invention are preferably used in knitting or weaving. The invention also provides for the use for these purposes.

The aramid fibers of the present invention are processible in particular into woven fabrics, knitted fabrics, laid fabrics, braids or webs.

As mentioned earlier, the spin finished aramid fibers of the present invention are notable for a whole series of advantageous properties.

Trials have shown that the temperature volatility of the spin finishes of the present invention within the range from 200° to 220° C. was less than 10%, whereas conventional spinning finishes have temperature volatilities of up to 60%.

Furthermore, the water vapor volatility of the spin finishes of the present invention at 102° C. is less than 10%, whereas conventional spin finishes have water vapor volatilities of up to 25%.

Moreover, the filament/metal friction of the spin finishes of the present invention is 15–20% lower than the values obtained with conventional systems.

In addition, it was found that the abrasion of the spin finishes of the present invention, for example in the course of twisting, was very low and the abraded-off material was in the form of a dust, was readily removable and did not form a tacky build-up on the deflecting elements. Compared with conventional systems, an improvement of about 50% was observed.

It was additionally found that the interfilament cohesion, or transverse cohesion between the filaments, of the spin finished aramid fibers of the present invention was about 10% higher than that obtained with conventional systems.

What is claimed is:

1. An aramid fiber having a spin finish comprising

A) an anionic antistat based on phosphoric esters, phosphonic esters, or a mixture of phosphoric and phosphonic esters, B) a compound of the formula I $$R^1—COO—(CH_2—CH_2—O—)_x—R^2 \quad \text{(I) and}$$

C) a compound of the formula II $$R^3—O—(R^4—O)_y—R^5 \quad \text{(II),}$$

where $R^1$ is $C_1$–$C_{22}$-alkyl or $C_2$–$C_{22}$-alkenyl, x is an integer from 2 to 20

$R^2$ is hydrogen or $C_1$–$C_{22}$-alkyl, $R^3$ is $C_1$–$C_{22}$-alkyl or $C_2$–$C_{22}$-alkenyl, y is an integer from 1 to 8, and $R^4$ is ethylene or, when y is 2, 3, or 4, some of the $R^4$ radicals can also be propylene or butylene, and $R^5$ is $C_1$–$C_{22}$-alkyl.

2. The aramid fiber of claim I where the amount of spin finish is from 0.5 to 4% by weight, based on the amount of fiber.

3. The aramid fiber of claim I where the anionic antistat is a salt of a mono- or dialkyl phosphate, a salt of a mono- or diaryl phosphate, a salt of an alkylphosphonic ester, a salt of an arylphosphonic ester or m mixture thereof.

4. The aramid fiber of claim 3 where the anionic antistat is an alkali metal salt of an alkyl alkylphosphonate or in particular an alkali metal salt of a mono- or dialkyl phosphate.

5. The aramid fiber of claim 4 where the anionic antistat is a potassium salt of a monoalkyl phosphate, dialkyl phosphate, or mixture thereof, whose alkyl groups have 8 to 20 carbon atoms.

6. The aramid fiber of claim 1 where $R^1$ is $C_{12}$–$C_{20}$-alkyl.

7. The aramid fiber of claim 1 where $R^2$ is methyl.

8. The aramid fiber of claim I where $R^3$ is $C_{12}$–$C_{20}$-alkyl.

9. The aramid fiber of claim 1 where $R^3$ is a bivalent, tervalent or tetravalent radical of an aliphatic alcohol with or without ethylenic unsaturation.

10. The aramid fiber of claim 1 where $R^5$ is methyl.

11. The aramid fiber of claim 1 where y is 1.

12. The aramid fiber of claim 1 wherein the aramid is an aromatic polyamide that is soluble in organic solvents.

13. The aramid fiber of claim 12 wherein the aromatic polyamide is a polymer with the structural repeat units of the formulae III, IV and optionally V $$—OC—Ar^1—CO—NH—Ar^2—NH— \quad \text{(III),}$$

$$—OC—Ar^1—CO—NH—Ar^3—NH— \quad \text{(IV),}$$

$$—OC—Ar^1—CO—NH—Ar^4—NH— \quad \text{(V),}$$

where $Ar^1$, $Ar^2$, $Ar^3$ and $Ar^4$ are each independently of the others a bivalent monocyclic or polycyclic aromatic radical whose free valences are disposed para or meta or comparably parallel, coaxial or angled to each other, and $Ar^2$, $Ar^3$ and, if present, $Ar^4$ each have different individual meanings within the scope of the given definitions, and the respective monomer components underlying the polymer are selected so as to produce an aromatic polyamide which forms isotropic solutions in organic solvents.

14. The aramid fiber of claim 13 wherein $Ar^1$ is a bivalent monocyclic or polycyclic aromatic radical whose free valences are disposed para or comparably parallel or coaxial to each other, $Ar^2$ is a bivalent monocyclic or polycyclic aromatic radical whose free valences are disposed para or comparably parallel or coaxial to each other, $Ar^3$ is a radical of the formula VI $$—Ar^5—X—Ar^6— \quad \text{(VI),}$$

where $Ar^5$ and $Ar^6$ are independently of each other a bivalent monocyclic or polycyclic aromatic radical whose free valences are disposed para or comparably parallel or coaxial to each other or where $Ar^6$ additionally is a bivalent monocyclic or polycyclic aromatic radical whose free valences are disposed meta or comparably angled to each other, X is a group of the formula —O—, —S—, —$SO_2$—, —O—phenylene—O— or alkylene, and where $Ar^4$ has one of the meanings defined for $Ar^2$ or $Ar^3$ but differs from the particular $Ar^2$ or $Ar^3$ of a molecule.

15. The aramid fiber of claim 14 wherein $Ar^1$ is 1,4-phenylene, $Ar^2$ is 1,4-phenylene or a bivalent radical of 4,4'-diaminobenzanilide, $Ar^5$ and $Ar^6$ are each 1,4-phenylene, X is —O—, —$CH_2$— or —O—1,4-phenylene—O—, and $Ar^4$ is a bivalent radical of 3,4'-diaminodiphenyl ether, of 3,3'-dichlorobenzidine, of 3,3'-dimethylbenzidine or of 3,3'-dimethoxybenzidine.

16. The fiber as claimed in claim 1, wherein x is from 3 to 15.

17. The fiber as claimed in claim 1, wherein $R^5$ is methyl.

* * * * *